US006098512A

United States Patent [19]

Life et al.

[11] Patent Number: 6,098,512

[45] Date of Patent: Aug. 8, 2000

[54] MULTIPLE NOZZLE FLUID CUTTING SYSTEM FOR CUTTING WEBBED MATERIALS

[75] Inventors: James A. Life, Rogers; Steven P. Brown, Springdale, both of Ark.

[73] Assignee: Rockline Industries, Inc., Sheboygan, Wis.

[21] Appl. No.: 09/061,651

[22] Filed: Apr. 17, 1998

[51] Int. Cl.[7] ..... B26D 3/00

[52] U.S. Cl. ..... 83/53; 83/76.8; 83/286

[58] Field of Search ..... 83/22, 27, 76.6, 83/76.8, 76.9, 177, 51, 53, 49, 286, 287, 289, 298

[56] References Cited

U.S. PATENT DOCUMENTS

| | | | |
|---|---|---|---|
| 2,881,503 | 4/1959 | Johnson | 83/53 |
| 3,978,748 | 9/1976 | Leslie et al. . | |
| 4,048,885 | 9/1977 | Miyakita et al. . | |
| 4,140,038 | 2/1979 | Higgins . | |
| 4,182,170 | 1/1980 | Grupp . | |
| 4,216,687 | 8/1980 | Passafiume et al. . | |
| 4,216,906 | 8/1980 | Olsen et al. . | |
| 4,246,838 | 1/1981 | Pulver et al. | 83/53 |
| 4,266,112 | 5/1981 | Niedermeyer . | |
| 4,435,902 | 3/1984 | Mercer et al. . | |
| 4,567,796 | 2/1986 | Kloehn et al. . | |
| 4,686,877 | 8/1987 | Jaritz et al. . | |
| 4,723,387 | 2/1988 | Krasnoff . | |
| 4,827,679 | 5/1989 | Earle, III . | |
| 4,847,954 | 7/1989 | Lapeyre et al. | 83/177 |
| 4,916,992 | 4/1990 | Nasu | 83/53 |
| 5,001,951 | 3/1991 | Eisenlohr et al. | 83/177 |
| 5,083,487 | 1/1992 | Croteau | 83/177 |
| 5,269,211 | 12/1993 | Flaming | 83/53 |
| 5,339,715 | 8/1994 | Coleman . | |
| 5,365,816 | 11/1994 | Rudy | 83/177 |
| 5,571,381 | 11/1996 | Vessari et al. | 83/53 |
| 5,636,558 | 6/1997 | Sanders et al. | 83/177 |

FOREIGN PATENT DOCUMENTS

| | | | |
|---|---|---|---|
| 0193199 | 8/1989 | Japan | 83/53 |

*Primary Examiner*—M. Rachuba

*Attorney, Agent, or Firm*—Reinhart, Boerner, Van Deuren, Norris & Rieselbach, s.c.

[57] ABSTRACT

A fluid jet cutting system for simultaneously making multiple cuts in a continuously moving layered web of paper or nonwoven material. The fluid jet cutting system includes a controller which monitors the web speed through an encoder feedback signal, and controls the travel speed and angle based on parameters stored in the controller memory and feedback signals. The user can select a cut length and other cutting parameters through an input device to the controller. Nozzles are mounted to a drive system including an adjustment device which allows fast easy and accurate adjustment of cut length.

29 Claims, 10 Drawing Sheets

MULTIPLE NOZZLE FLUID CUTTING SYSTEM FOR CUTTING WEBBED MATERIALS

BACKGROUND

This invention relates generally to cutting, and more particularly to an apparatus and method for cutting multiple stacks of a desired length from a moving stack of sheet material using high pressure fluid jet streams.

Single blade oscillating or radial saw blades are typically used to cut stacks of flat sheet material into stacks sized for consumer uses. Systems which employ saw blades, while effective for certain uses, suffer from several disadvantages. First, saw blades become dull through the cutting process, and must be continually sharpened, especially when the blades are used to cut extremely tough or durable material such as paper or nonwoven material. Therefore, saw cutting systems often include a timed grindstone which sharpens the blade while in operation. After every sharpening, a residue of abrasive materials, such as carbon particles, is present on the blade. This residue, along with grinding dust, is transferred to the stacks or sheets produced immediately after sharpening. These stacks, therefore, cannot be sold to consumers and must be deposited in a landfill, causing a significant amount of waste. Furthermore, when the paper or nonwoven material being cut is moisture impregnated, centrifugal force from the spinning saw causes liquid to be splattered in a 360 degree circle inside the saw enclosure. The liquid material accumulating inside the saw enclosure is a prime breeding ground for fungus, mold, and germs. The liquid also frequently combines with loose fibers, grinding dust, and other materials, and eventually drops from the saw enclosure onto the products moving through the saw system. These products, therefore, cannot be sold to consumers.

Fluid jet cutting systems are also known in the art. Fluid jet cutting systems have generally been used for cutting stationary sheet material. These systems typically employ a single nozzle. The nozzle may move above stationary material, or material may move beneath a stationary nozzle. In some cases multiple nozzles have been employed to cut multiple sheets from a single stationary sheet. Some systems employ computer control to produce multiple cut patterns in the stationary sheet.

Fluid jet cutting systems have also been used for cutting a continuously moving single web of material. These systems typically employ a single nozzle which makes a single predefined cut in a sheet of material. Therefore, multiple systems are required to make simultaneous multiple cuts in a web of material. In addition, the cut is typically a fixed length or pattern, and therefore can be used only to cut one specific length or shape. Therefore, if it is desirable to supply a variety of products in different shapes and sizes, a different system must be provided for each required cut. Each system requires a significant capital expenditure. Therefore, existing fluid jet cutting systems for cutting a continuously moving web of material are typically very expensive and relatively inefficient.

It is therefore an object of the present invention to provide an improved apparatus and method for simultaneously cutting a plurality of stacks or sheets of a desired length from a moving web of material.

It is another object of the invention to provide a novel method and apparatus for cutting a continuously moving web of material which produce a minimal amount of waste.

It is yet another object of the invention to provide an improved method and apparatus for cutting a continuously moving web of material which require minimal maintenance.

It is still another object of the invention to provide a novel method and apparatus for cutting a continuously moving web of material with minimal down time.

It is a still further object of the invention to provide an improved method and apparatus for cutting a continuously moving web of stacked paper or nonwoven material quickly and cleanly.

It is a still further object of the invention to provide a novel method and apparatus for cutting a continuously moving web of material which provides a variety of different cut sizes.

It is yet another object of the invention to provide a cutting apparatus which is programmable and provides different cut lengths.

SUMMARY OF THE INVENTION

The inventors have discovered fluid jets can cut continuously moving stacks of durable sheet material cleanly and quickly if a number of parameters are carefully controlled. The present invention provides a method for cutting a continuously moving web or stack of material which greatly increases throughput by simultaneously cutting multiple sheets or packs of stacked material at a high speed, and which is particularly useful for cutting stacks of durable sheet material such as paper or nonwoven material. The cutting operation is performed by a series of fluid jets. Fluid jet cutting is significantly faster and more efficient than saw cutting when the fluid cutting operation parameters are carefully controlled. For example, a saw cutting operation typically can cut no more than 300 stacks per minute of paper or nonwoven material. The number of stacks is limited by the mass of the saw. The present invention, however, can provide over 400 stacks per minute, over 33% more than the output of a typical saw cutting system. Furthermore, because the system can continue to operate during routine maintenance, such as the replacement of seals in the intensifier units, fluid jet cutting reduces the amount of total production down time. When it is necessary to replace the intensifier seal in one intensifier, other intensifiers can continue to supply fluid to the nozzles, thereby allowing limited production through the maintenance cycle. In addition, worn or malfunctioning nozzles can be unscrewed and replaced quickly and easily. Furthermore, intensifiers are significantly less expensive than saws. The cost of a replacement saw is approximately six hundred thousand dollars, while the cost of a three intensifier system is only about three hundred thousand dollars. A backup system for a fluid jet cutting system is therefore significantly less expensive than a backup system for a saw system. As a result, down time can be controlled more easily and more simply in the fluid cutting system of the present invention than in traditional saw cutting operations. Additionally, because intensifiers are relatively inexpensive, the fluid jet cutting system can be easily and inexpensively modified to provide additional cutting elements. Fluid jet cutting systems, therefore, are more versatile than saw cutting systems.

To perform multiple cuts, a plurality of nozzles are mounted to a plate, and the plate is positioned near the continuously moving web of material. When the plate is in position, a jet of fluid is directed from each nozzle onto the web of material, and the plate is driven in x and y Cartesian coordinates to provide a first plurality of cuts equal to the number of nozzles. The first plurality of cuts are preferably perpendicular to the sides of the web, and extend from the first side of the web to the second side of the web. When the first plurality of cuts are complete, the plate is driven to a second position to provide a second plurality of cuts, also preferably perpendicular to the sides of the web, extending from the second side of the web to the first side of the web.

In accordance with one preferred embodiment of the invention, the nozzles are adapted to be moved relative to each other on the plate to provide various cut lengths. These cut length values can be entered into the memory of a controller through an input device such as a keyboard. A controller determines the proper travel speed and travel angle for the nozzles to cut the desired length sheet or pack of stacked material from the continuously moving web, based on the desired length, and the speed of the continuously moving web. The input web speed is monitored by an encoder mounted to the input conveyor, and is provided to the controller as a real-time feedback signal. Therefore, corrections can be made to system cutting parameters to compensate for variations in input web speed.

Other advantages and features of the invention, together with the organization and manner of operation thereof, will become apparent from the following detailed description when taken in conjunction with the accompanying drawings wherein like elements have like numerals throughout the drawings.

DETAILED DESCRIPTION OF THE PREFERRED EMBODIMENT

Figure 1:
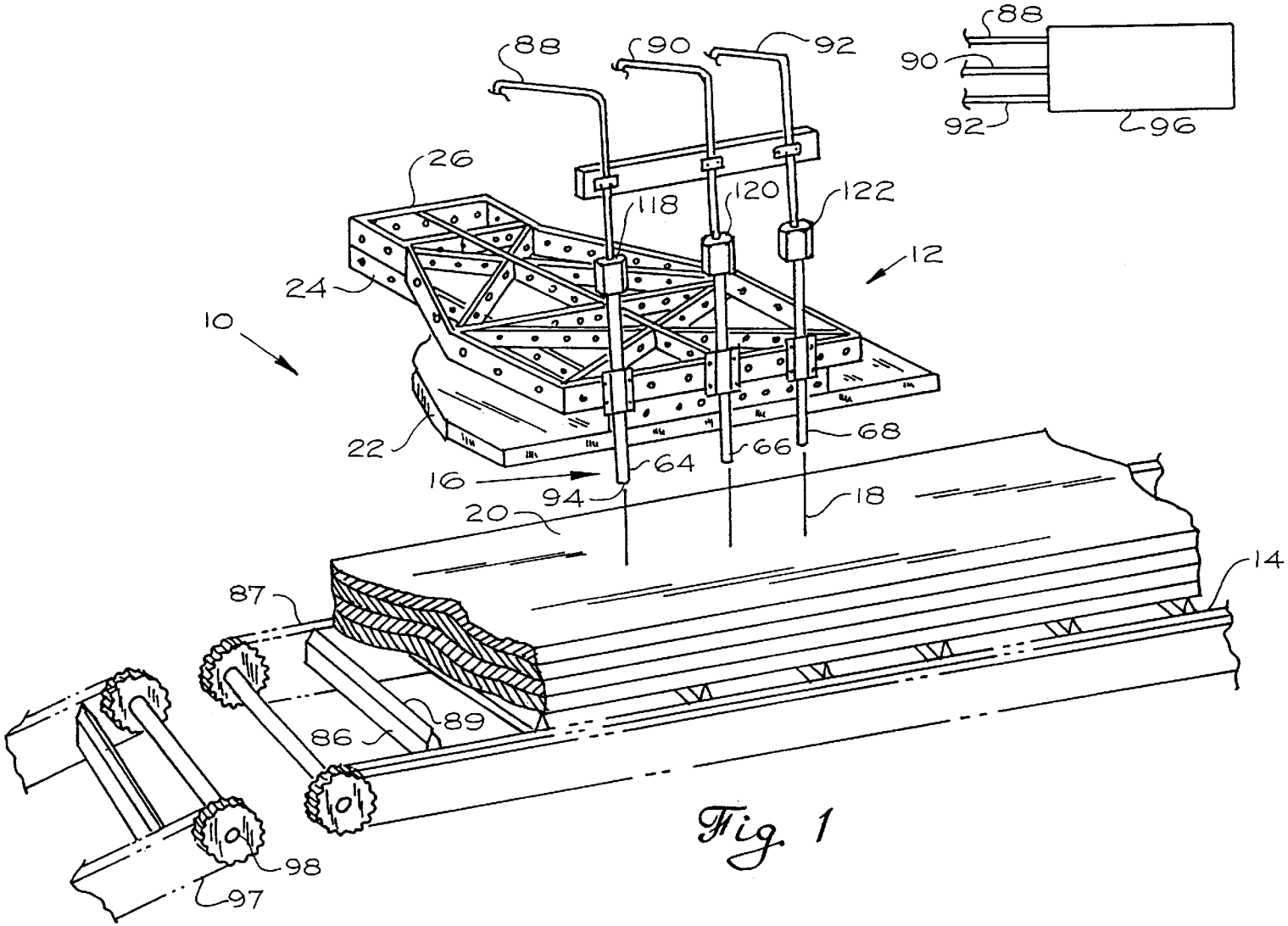
FIG. 1 is a simplified representation of a fluid jet cutting apparatus constructed in accordance with the present invention.

Referring to the Figures, and more particularly to FIG. 1, a fluid jet cutting apparatus constructed in accordance with one preferred embodiment of the invention is illustrated at 10. The cutting apparatus 10 includes a plurality of nozzles to simultaneously cut either multiple layered stacks or sheets of webbed material. The cutting apparatus 10 cuts the layered stack or sheet of webbed material into a series of stacks of sheets of a predetermined length. The cutting apparatus can be used to cut any sheet or web material, but is particularly useful for cutting tough or durable sheet material at high material feed rates. Preferably, the material comprises moistened nonwoven material. Nonwoven material often is a specialized extremely tough web material which is designed to remain wet when packaged. This material is frequently used in medical wipes and personal hygiene products such as baby wipes, wet napkins, and wipes for removing cosmetics. To achieve clean cuts through paper or nonwoven material at a high rate of speed, a number of cutting parameters are carefully controlled.

In accordance with one preferred embodiment of the invention, the cutting apparatus 10 comprises a drive system 12, a conveyor 14, and a plurality of nozzles 16 coupled to an intensified source of fluid 18. The plurality of nozzles 16 are coupled to the drive system 12, and are driven in x and y Cartesian coordinates. Preferably, the nozzles 16 are positioned over a web of material 20 moving on the conveyor 14; however, the nozzles 16 could also be positioned beneath or along the side of the web of material 20. While FIG. 1 illustrates a cutting apparatus 10 which employs three nozzles, it is understood that the apparatus can support any number of nozzles. It is also understood that, although the material is hereinafter referred to as a web, the web of material 20 preferably comprises a layered stack of material.

Figures 2A, 2B:
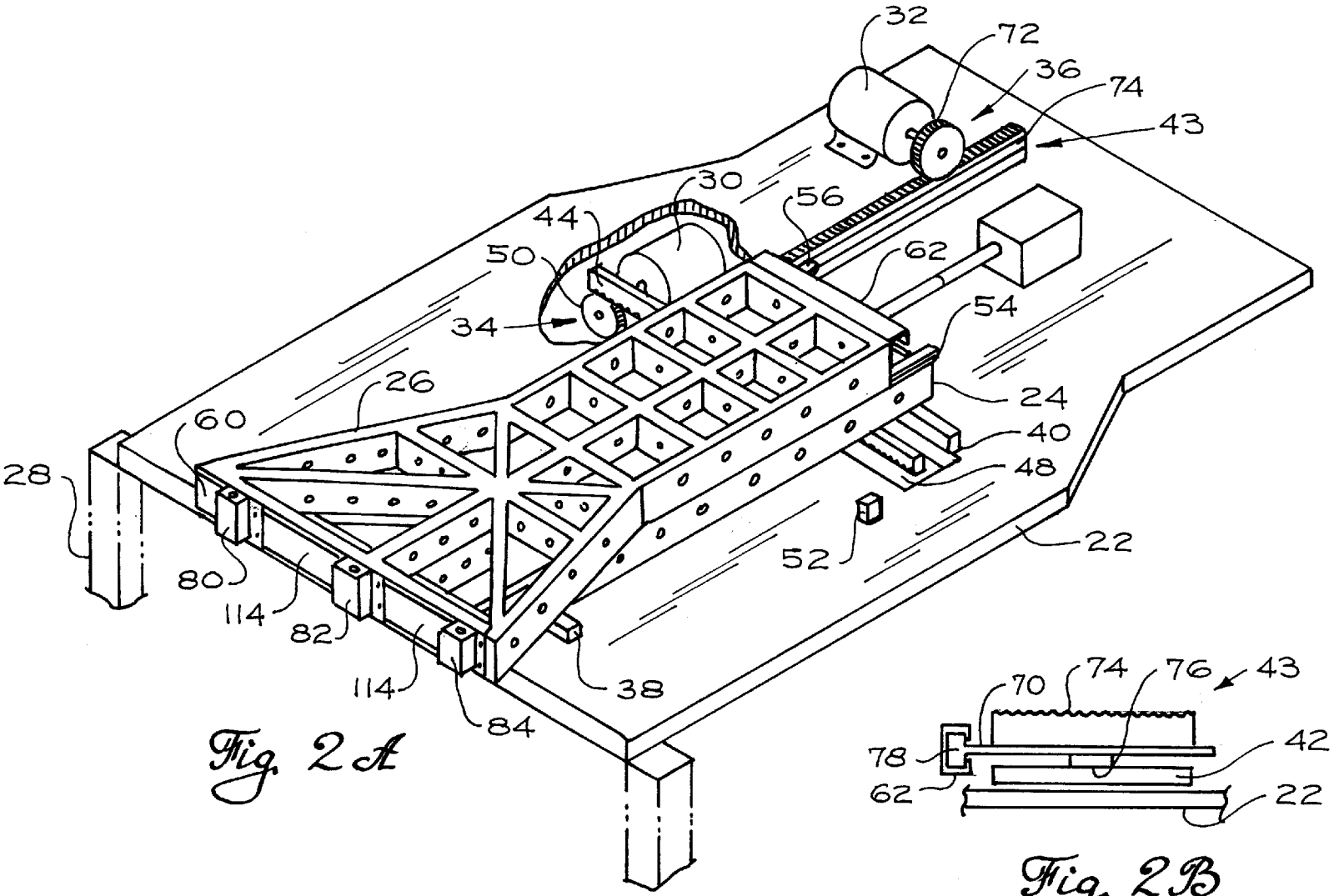
FIG. 2A is a top isometric view of the fluid jet cutting apparatus shown in FIG. 1, partially cut away to show an x-drive rail system thereof
FIG. 2B is a side view illustrating a y-drive rail system of the drive system shown in FIG. 2.

Referring additionally to FIGS. 2A and 2B, the drive system 12 comprises three structural parts: a stationary base plate 22, an x-plate 24, and a y-plate 26. The x-plate 24 and y-plate 26 must be able to withstand vibrations in the system, yet be lightweight to allow the system to operate at maximum speed. Preferably, these plates comprise aluminum, although other materials may also be used. Furthermore, all of the structural components, including the stationary plate 22, x-plate 24, y-plate 26, and frame 28 must be made of non-corrosive material both because of the wet environment in which the fluid jet cutting system 10 operates, and because lotions which are used in consumer products such as wet napkins and medical wipes are often corrosive. Preferably, all of these components are treated with a non-corrosive coating which can be baked or painted on aluminum or other lightweight materials. A vacuum system may also be used to remove atomized water from the inside enclosure of the cutting system, thereby decreasing the corrosive effects of the environment.

The stationary base plate 22 is mounted to a frame 28 and supports two motors: an x-direction motor 30 and a y-direction motor 32. The motor 30 drives a rack and pinion drive system 34 which drives the x plate in the x directions. Similarly, The motor 32 drives a rack and pinion drive system 36 which drives the y-plate 26 in the y direction. Two conventional linear rails 38 and 40 are mounted on the stationary base plate 22 and extend along the x-axis in a parallel relationship. A third linear rail 42 is mounted to the stationary base plate 22 and extends in the y-direction. Preferably, the x and y-direction motors comprise AC brushless servo motors, and the rack and pinion comprise AGMA 11 tolerance gears to provide accuracy. Although rack and pinion drive systems are preferred, timing belt and pulley or cylinder and transducer drive systems may also be used.

The x-plate 24 is driven by a rack 44 and pinion 50 drive system which extends through an x-extending slot 48 in the stationary base plate 22. The pinion 50 is coupled to the motor 30. Limit switches 52 are positioned on either end of the slot 48, to limit total motion in the x-direction. Conventional bearings (not shown), mounted to the bottom of the plate, are coupled to the linear rails 38 and 40 mounted to the base plate 22 in the x-direction. The bearings and linear rails 38 and 40 allow the x-plate 24 to move smoothly in the x-direction. Preferably, material is removed from the x-plate 24 in order to lighten the load, thereby reducing the size of the motor 30 required. A pair of linear rails 54 and 56 are coupled to the x-plate 24 and provide a location for coupling the y-plate 26 to the x-plate 24.

The y-plate 26 includes conventional bearings (not shown) which couple the y-plate 26 to the linear rails 54 and 56. The conventional bearings allow the y-plate 26 to move simultaneously with the x-plate 24 in the x-direction. X-directional linear rails 60 and 62 are positioned at opposite ends of the y-plate 26. Nozzles 64, 66, and 68 are moveably coupled to the x-directional rail 60 at the end nearest the web 20, while the y-directional tram 70 is moveably coupled to the x-directional rail 62 at the opposite end of the y-plate 26. Therefore, the y-plate 26 moves in the x-direction simultaneously with the x-plate 24, but maintains contact with the y-directional rack 74 and pinion 72 drive, and therefore is also driven in the y-direction. The y-plate 26, therefore, and the nozzles 64, 66, and 68 move in both the x and y Cartesian coordinates. Again, excess material is removed from the y-plate 24 in order to lighten the load and reduce the size of the motor 32 required.

As noted above, the y-plate is driven in both the x and y directions. To control the motion of the y-plate in the y-direction, the stationary y-drive system 36 must maintain contact with the y-plate 26 as it moves in both the x and y directions. The function of maintaining contact between the moving y-plate 26 and the stationary y-drive system 36 is provided by the y-rail system 43.

Referring to FIG. 2B, the y-rail system 43 is shown in detail. The y-rail system 43 includes a telescoping tram 70, the y-rack 74, a y bearing 76, an x-bearing 78, and the y-rail 42. The telescoping tram 70 is coupled to the y-plate 26 through the x-bearing 78, to the y-drive system 36 through the rack 74, and to the y-rail 42 through the y bearing 76.

As the motor 32 turns the pinion 72, the rack 74 is caused to move in the y-direction. The rack, in turn causes the tram 70 to move along the y rail 42, thereby causing the y-plate 26 to move in the y-direction. The telescoping tram 70 accounts for any change in distance between the y-plate 26 and the y-drive system 36. As the y-plate 26 moves in the x-direction, the x bearing 78 maintains contact with the y-plate 26 through the rail 62, while allowing the y-plate 26 to move as required.

The nozzles 64, 66 and 68 are moveably coupled to the x-directional rail 60 by nozzle brackets, 80, 82, and 84, respectively. The nozzle brackets 80, 82, and 84 and, hence, the nozzles 64, 66, and 68 can be independently moved along the x-directional rail 60. The distance between the nozzles defines the length of the cut to be made in the web 20. Therefore, by adjusting the position of the nozzles 64, 66, and 68, different cut lengths 114 can be achieved. Generally the nozzle 66 will be centered between the nozzles 64 and 68, and spaced a cut length 114 from each of the nozzles 64 and 68. The nozzle brackets 80, 82, and 84 may include micrometers or other microadjusting instruments to provide an exact cut length.

Referring to FIG. 1, high pressure fluid 18 is delivered to each nozzle 64, 66, and 68 by separate tubing 88, 90 and 92, respectively. Each nozzle 64, 66 and 68 includes an orifice 94 for directing the fluid 18 from the nozzle to the continuously moving web 20. The fluid 18 is pressurized by one or more intensifiers 96. The pressure of the fluid 18 is maintained at a value which provides optimal cutting. Preferably, the orifices 94 are diamond tipped but sapphire or other jeweled orifices are also suitable. Although pure water is the preferred fluid 18, other types of fluids 18 can also be used. Although one intensifier 96 is shown, it is advantageous to use a plurality of intensifiers 96. In this case, the fluid cutting system 10 can continue to cut when one or more intensifier is removed for maintenance purposes.

In some cases, especially when frequent material changes are expected, it may be desirable to add an apparatus and adjust the nozzle motion in the Z-direction. In all cases, it is important to maintain the nozzles 64, 66 and 68 at a constant distance, and relatively close to the top of the web 20 in the z-direction, regardless of the thickness of the web 20 which is cut. The distance is an important parameter because as fluid 18 leaves the nozzles 64, 66, and 68, it dispenses in a cone-shaped pattern. Therefore, as the distance from the nozzles 64, 66 and 68 increases, the width of the cut increases accordingly. To assure a clean cut, the nozzles are preferably relatively long, and are positioned near the top of the web 20 during cutting operations. Also to assure a clean, narrow cut, conventional nozzles which allow the fluid to settle before being ejected from the nozzle for the cutting operation are preferred. To assure proper distance in the z-direction, microadjustment clamps and other known devices can be used to position the nozzles 64, 66, and 68 in the z direction.

Figure 3:
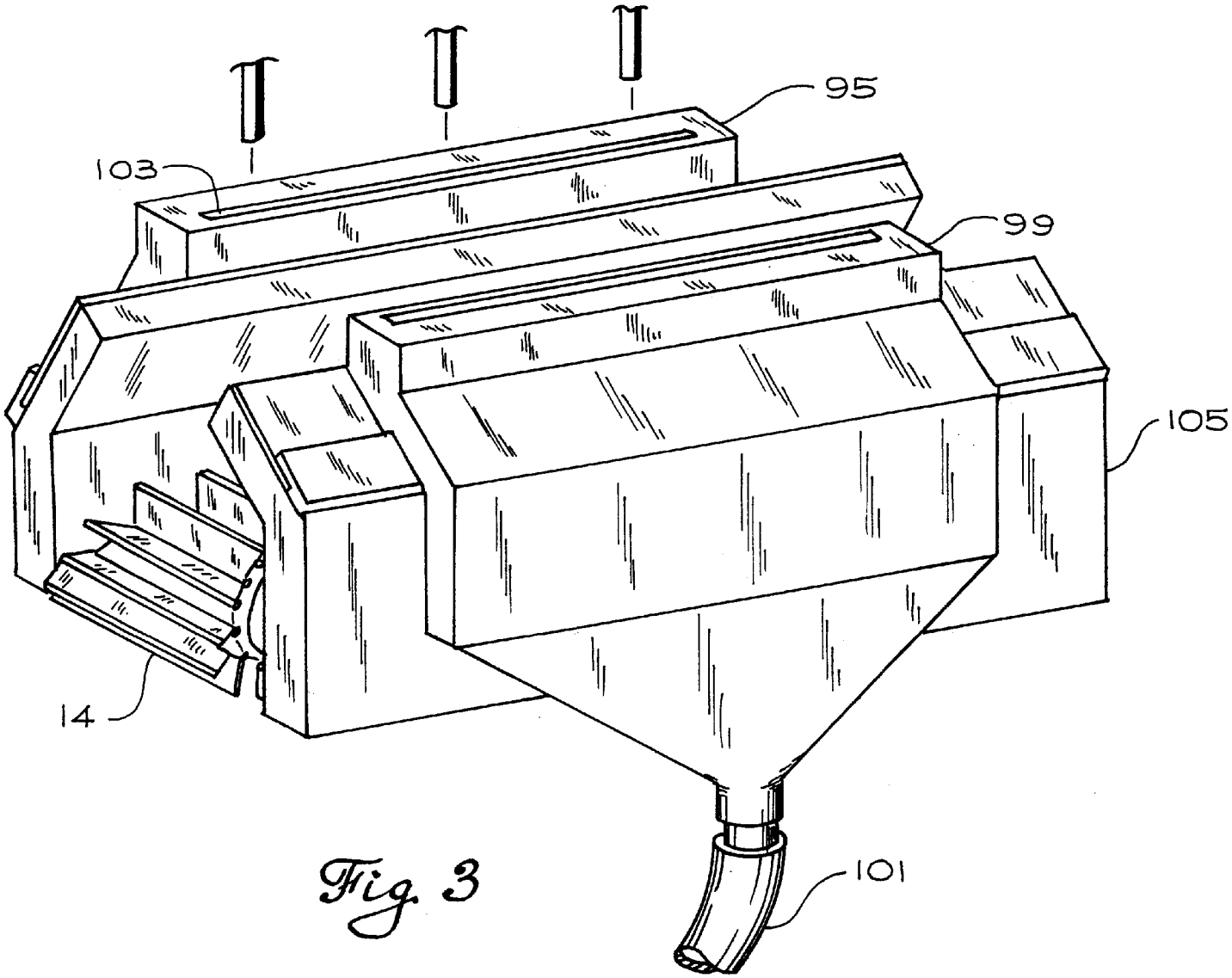
FIG. 3 is a side view illustrating a wet vacuum system constructed in accordance with the present invention.

To minimize extraneous fluid spray in the jet cutting operation, a wet vacuum system 93, as is seen in FIG. 3, is preferably used. The wet vacuum system 93 comprises two mist vacuum manifolds 95 and 99 which are connected to a suction device (not shown) through a drain pipe system 101. The vacuum manifold 95 is mounted to a first mounting bracket 105 positioned on one side of the conveyor 14, and the vacuum manifold 99 is mounted to a mirror-image bracket mounted on the opposite side of the conveyor 14. Preferably, the mounting brackets 105 comprise hardened tool steel where the vacuum manifolds 95 and 99 are coupled to the brackets 105. The suction device draws mist into the wet vacuum system 93 through a series of holes 103 in the vacuum manifolds 95 and 99, and the extraneous fluid is led to a drain through the drain pipe system 101. The wet vacuum system 93 prevents water from accumulating during the fluid cutting operation. This is particularly important for preventing the build up of dirt and bacteria which can damage the end products. Although the wet vacuum system 93 is shown with two vacuum manifolds, it is understood that any number of manifolds could be used. Preferably the mounting brackets 105 are moveably coupled to the conveyor 14, thereby allowing the brackets to be moved to widen the cutting area for wider material.

To provide continuous motion, the web 20 is positioned on a conveyor 14. Preferably the conveyor comprises a non-corrosive hardened metal alloy material which is resistant to fluid cutting effects, such as stainless steel. The conveyor 14 comprises a series of stainless steel flights 86, wherein the opposing sides of each stainless steel flight are attached to a stainless steel roller chain driver 87, and biased at an angle, generally between five and ten degrees, although the angle may vary depending on the application. The top end of each flight 86 narrows inwardly from each side as they approach the web of material 20, thereby forming a v-shape in which only a narrow edge 89 contacts the web 20.

Figure 4:
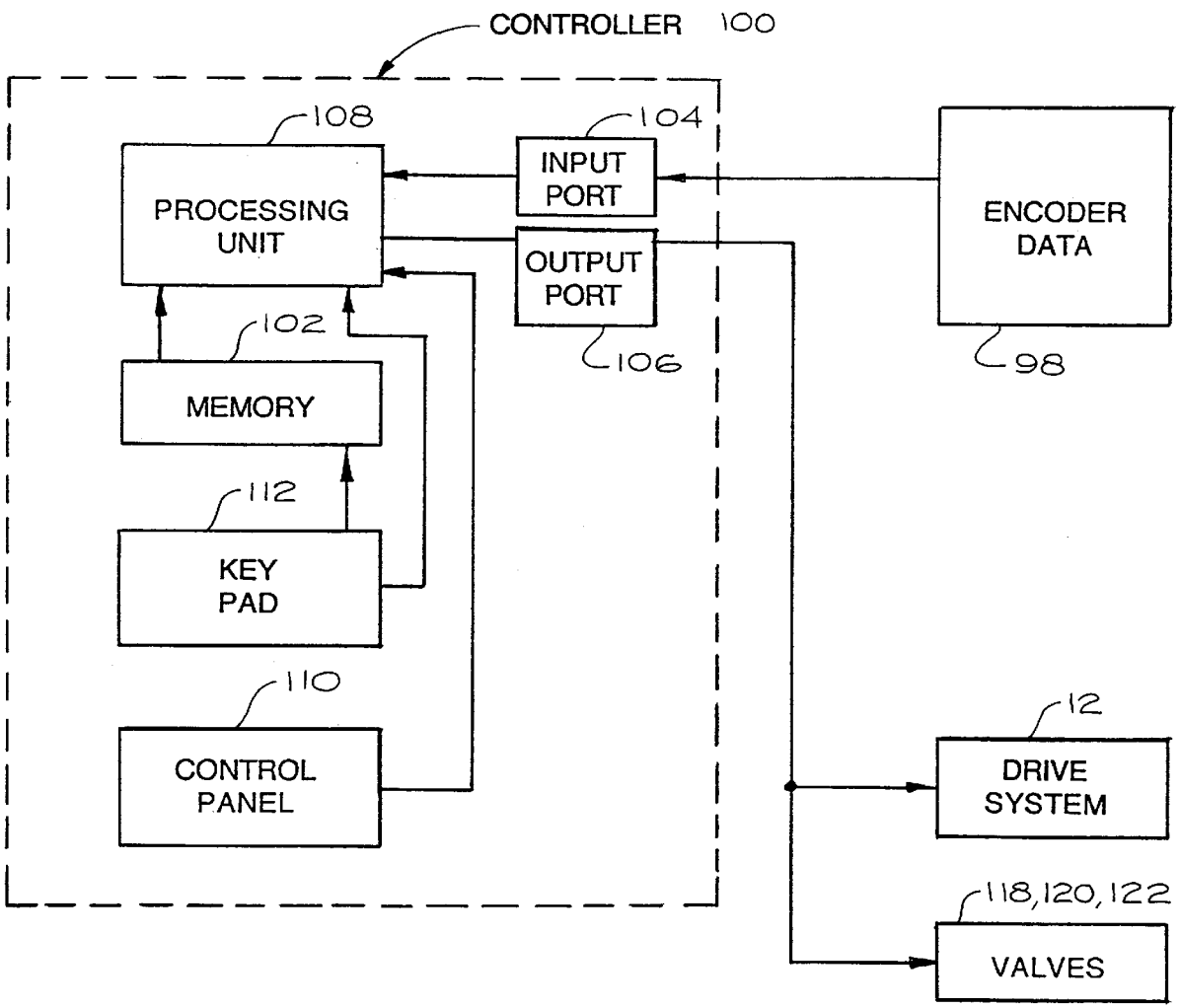
FIG. 4 is a block diagram of a controller for controlling the fluid jet cutting apparatus shown in FIG. 1.

The angled sides dissipate the effects of the fluid 18 on the components below the conveyor 14, and also minimize the back-splash of fluid 18 onto the web 20. Furthermore, the amount of stainless steel which contacts the web 20 is minimized, allowing a cleaner cut through the paper, and making it possible to use a smaller orifice 94. The smaller orifice 94 in turn decreases the amount of fluid 18 required. An encoder 98 is coupled to the input conveyor 97 to provide web input speed signals, signifying the real-time speed and the position of the web 20, which are supplied to a controller 100 (FIG. 4). Typically, the conveyor 97 and encoder 98 are mounted to a conventional frame and drive mechanism.

Referring to FIGS. 1 and 4, the operation of the fluid jet cutting apparatus 10 is preferably controlled by a controller 100. The controller 100 includes memory 102, for storing either constant or variable parameters, an input port 104 for receiving input signals from external devices, an output port 106, for driving external devices, such as the drive system 12, and a processing unit 108. The processing unit 108 monitors the input signals and produces the proper output signals based on the input signals and parameter data stored in the memory 102. A control panel 110 provides power on/off, emergency stop, cycle start/stop, and water on/auto/off functions. Preferably, data can be inserted into the memory 102 through a keypad 112. For example, the operator can use the keypad 112 to select a variety of cut lengths 114 for the web 20, for selecting the number of nozzles to be used for a single cut, and for selecting the speed of the conveyor 14. In alternative embodiments, the operator can select a web thickness, select between a variety of cut patterns, and select between various materials. However, in some applications, it may be desirable to dedicate the fluid cutting system to one production line. In these applications, the cut length and other parameters are fixed values. While a keypad 112 has been described, it is understood that alternate input devices, such as touch screens, disk drives or serial communications could also supply input data.

Referring to FIGS. 1, 2A, 5A, 5B, and 6, the y-plate 26 is initially positioned with the nozzle 68 located above a first cut start position 116. The controller 100 provides a series of control or command signals through the output port 106 for the conveyor 14, the rack and pinion drives 34 and 36, and the valves 118, 120, and 122 which control fluid flow to the nozzles 64, 66, and 68. Upon receiving a start signal, the conveyor 14 begins to move at a predetermined web speed, thereby providing continuous motion to the web 20. A further signal causes the valves 118, 120, and 122 to open and to supply fluid 18 from intensifier units 96 to each of the nozzles 64, 66, and 68. The nozzles 64, 66, and 68 direct a jet of fluid 18 onto the continuously moving web 20. The controller 100 further supplies initial speed commands to the motors 30 and 32, which in turn drive the rack and pinion drives 34 and 36 to cause the x-plate to move in the x-direction and y-plate to move in both x and y Cartesian coordinates.

Figure 6:
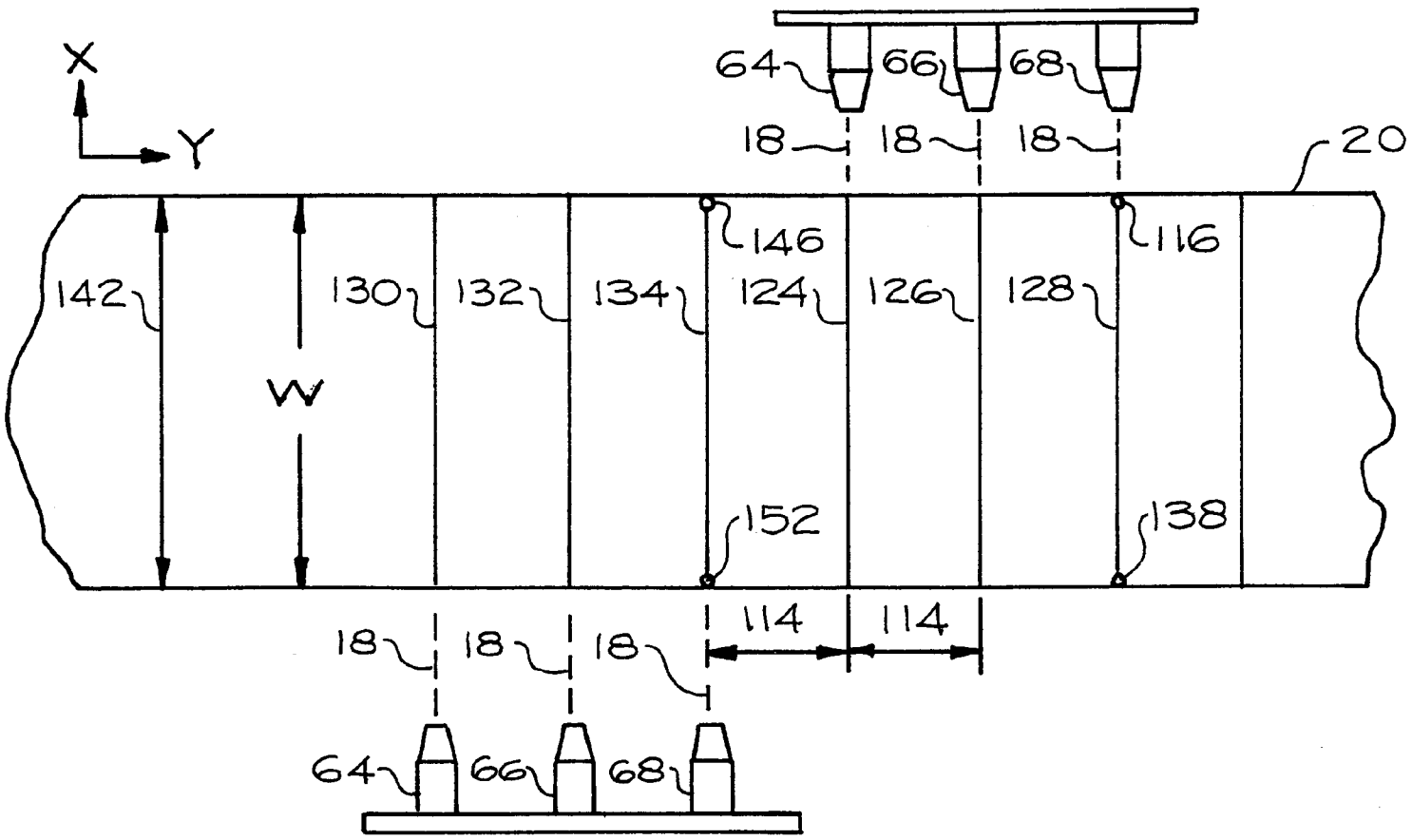
FIG. 6 is a simplified representation of the fluid jet cutting apparatus of FIGS. 1 and shows the cuts made across a continuously moving stack of webbed material in one cycle.

The nozzles 64, 66 and 68 make cuts 124, 126, and 128, respectively, in the first cutting pass, and make cuts 130, 132, and 134 in the second cutting pass. FIG. 6 shows the six cuts 124, 126, 128, 130, 132, and 134 as they are made on the continuously moving web 20 in the course of a single cycle. The cut length, which is the distance between successive cuts, is represented by the reference numeral 114.

Figure 5A:
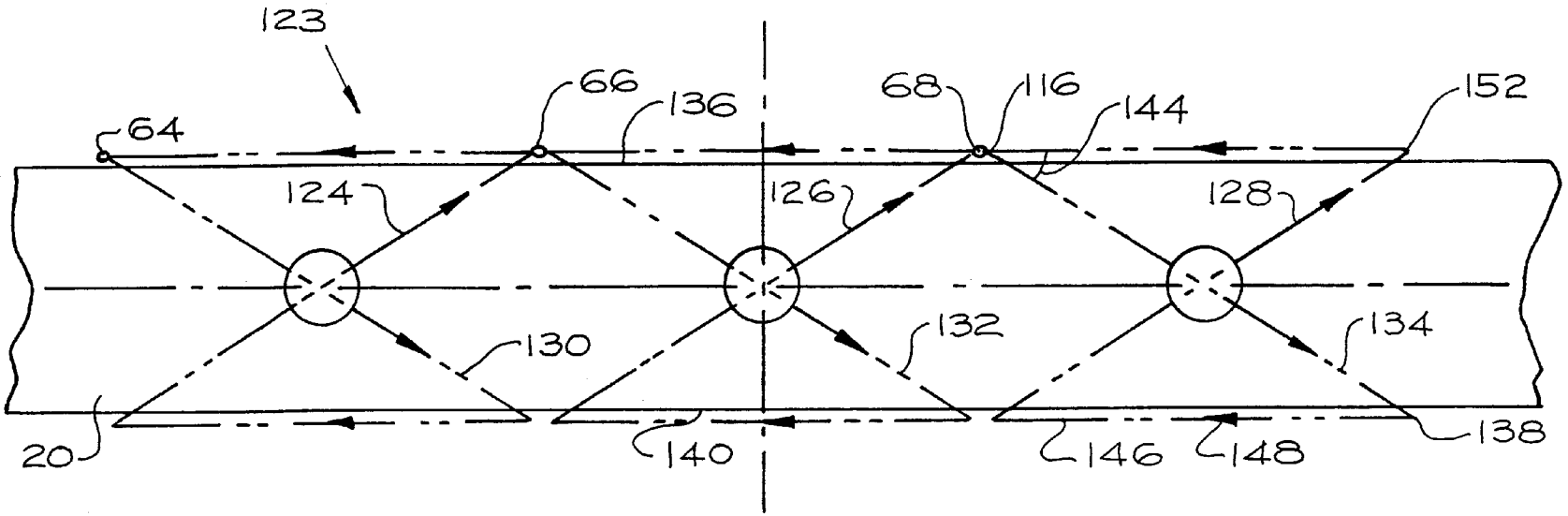
FIG. 5A is a diagram illustrating the paths followed by the nozzles of the fluid jet cutting system, referenced to a stationary point.

Referring to FIG. 5A, the cut path followed by the nozzles 64, 66, and 68, in a single cut cycle is shown. In a given cycle, the nozzles 64, 66, and 68 each move in a bow tie pattern 123 to make six cuts in two cutting passes. More specifically, as can be seen in FIG. 5A, during the first cutting pass, the nozzles 64, 66, and 68 are driven across the continuously moving web 20 in a first set of parallel diagonal paths represented by the cuts 124, 126, and 128. Focusing on the movement of nozzle 68, the cut 128 begins at a first cut start cut position 116 on one side 136 of the web 20 and extends to a first cut end position 138 on the opposite side 140 of the web 20. Referring also to FIGS. 2A and 4, in providing a perpendicular cut across the continuously moving web 20, the controller 100 commands the motor 32 to drive the drive system 12 across the width 142 of the web 20, in the y-direction, at a predetermined speed which is related to optimal cutting. Simultaneously, the controller 100 commands the motor 32 to drive the drive system 12 in the x-direction at the speed of the web. Therefore, while the fluid 18 is cutting the continuously moving web 20, the nozzles 64, 66, and 68 are moved along a straight line that extends at a travel angle 144 related to the direction of movement of the web 20 such that the cuts 124, 126, and 128 lie in a plane substantially perpendicular to the direction of movement of the web. The controller 100 continuously uses the input web speed signals provided by the encoder 98, and compensates for any changes in the web speed by commanding a corresponding change to the x motor 30. Therefore, the controller 100 maintains the motion of the nozzles 64, 66, and 68 at a constant travel angle 144 throughout the cut. The cut time required for the first cut is equal to the width 142 of the web 20 divided by the travel speed of the nozzles in the y-direction. During this time, the web 20 and the nozzles 64, 66, and 68 move a length in the x direction equal to the cut time multiplied by the web speed.

Referring again to FIG. 5A, upon completion of the first set of parallel cuts 124, 126, and 128, the controller 100 commands the drive system 12 to move the nozzles 64, 66, and 68 along the side 140 of the web 20 in the direction opposite the direction of movement of the web 20 (negative x-direction) until the nozzle 68 is aligned with a second cut start position 146, located directly across the web from the first cut start position 116. The return path 148 traveled by the nozzles 64, 66, and 68 can be generally straight or generally arcuate. The speed of the nozzles 64, 66 and 68 along this path is determined in the processing unit 108 of the controller 100 based on the cut length 114. The time required to travel the length of the return path 148 must be sufficient to allow the web to progress in the x direction to a position such that the first cut made in the second cutting pass 130, is spaced a cut length 114 from the cut 128 made in the first cutting pass. While traveling along the return path 148, the valves 118, 120, and 122 remain open and continue to supply fluid 18 to the nozzles 64,66 and 68. The excess fluid 18 is directed to a conventional fluid catcher. The location of the second cut start position 146, in relation to cut 124, is seen in FIG. 6.

When the web 20 and nozzles 64, 66, and 68 are properly positioned, the second set of parallel diagonal cuts 130, 132, and 134 across the web 20 is made in the same manner in which the first set of cuts 124, 126, 128 were made. However, for the second set of cuts, the drive system 12 is driven across the web in the opposite y-direction as compared to the first set of cuts 124, 126, 128. Consequently, when making the second set of cuts 130, 132, and 134, the path followed by the nozzles 64, 66, and 68 intersects the initial path at substantially the center of the web 20. The cut is completed when the nozzles 64, 66, and 68 reach the second cut end position 152.

Figure 5B:
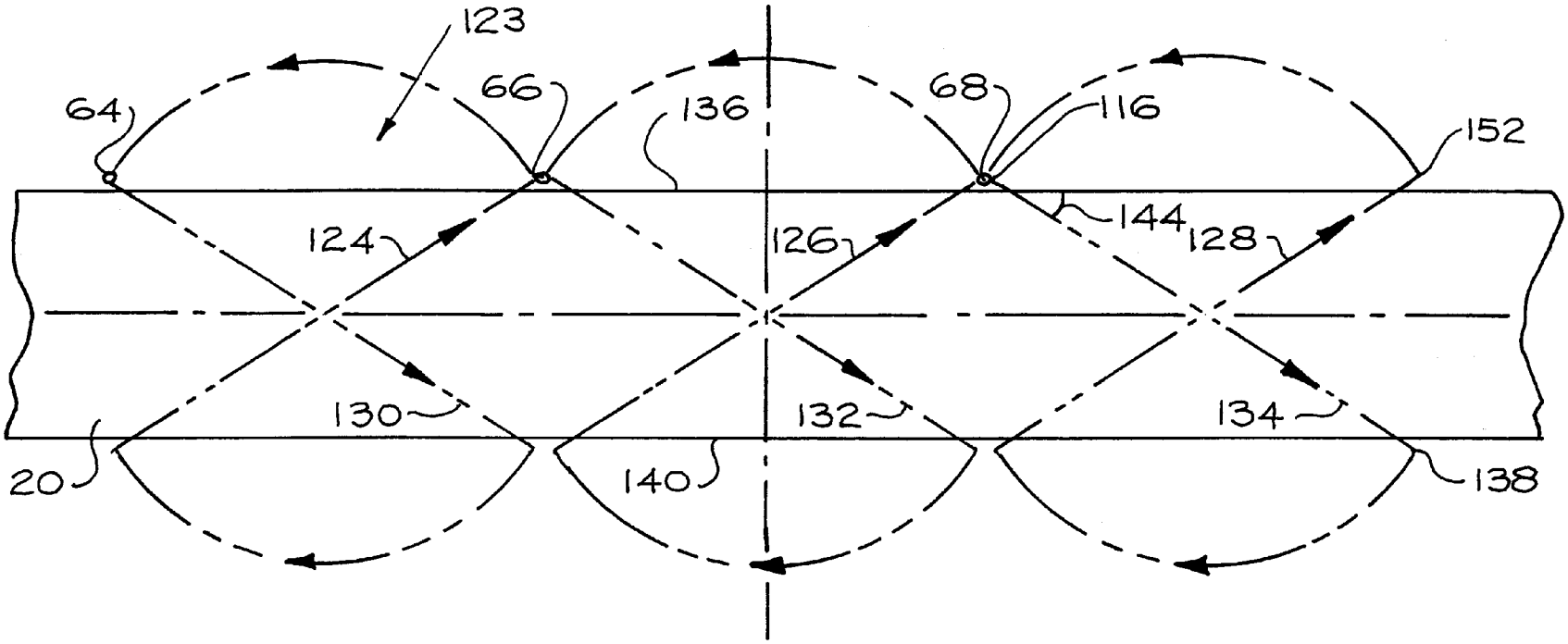
FIG. 5B is a diagram illustrating an alternative embodiment of the paths followed by the nozzles of the fluid jet cutting system, referenced to a stationary point.

Upon completion of the second set of cuts 130, 132, and 134, the controller 100 again commands the motors 30 and 32 to move the nozzles 64, 66, and 68 in either a generally straight along the side 136 of the web 20 in the negative y-direction to the first cut start position 116 for the start of a second cycle. As noted above, when the cycle is completed, the total movement of each nozzle 64, 66, and 68 preferably defines a bow tie pattern 123. Although a bow tie pattern is preferred, the cut path may also be in the shape of a figure eight as shown in FIG. 5B. In this case, the nozzles move in a generally arcuate path along the side 136 of the web 20 to return to the first cut start position 116.

In one preferred embodiment, especially suited for cutting stacks of baby wipes from a layered stack of paper or nonwoven material, the width 142 of the web 20 is 4 inches, and the cut length 114 is defined to be 7.1 inches. The material to be cut may range from one quarter inch to six inches in height. Preferably, material cut ranges between a stack height of two and one half inches (commonly known as an eighty count stack) to a stack height of three and one half inches (commonly known as a ninety-six count stack). The web preferably moves at a speed of 2840 inches per minute, and the optimum travel speed for cutting in the y-direction has been found to be 1800 inches per minute. Based on these values, the cut time across the four inch width of the web is 0.1333 seconds. In this time period, the nozzles must move in the x direction a length of 6.31 inches. The return path 148, therefore, is also 6.31 inches. To position the web for the second cut, the nozzles must be returned to the second start position 146 in a time of approximately 0.3 seconds. Therefore, one cycle cuts six stacks of material from a continuously moving web in slightly less than 0.9 seconds, representing a speed of approximately four hundred cuts per minute. For optimal cuts through paper or nonwoven material, it has been determined that nozzles 64, 66, and 68 should have an orifice 94 with a diameter in the range of 0.008 to 0.018 inches, and that the fluid 18 should be pressurized to a level of 40,000 to 60,000 pounds per square inch (psi). Most preferably, the diameter of the orifice is substantially in the range of 0.01 to 0.014 inches, and the fluid is pressurized to 45,000 psi. Through the use of these cutting parameters, in conjunction with the feedback speed control of the controller 100, part tolerances are kept in the following ranges: (1) length:+/−0.0625 inches; and (2) cut line accuracy:+/−0.031. Although a cut length 114 of 7.1 inches has been described, these accuracy levels can be reached for a cut length 114 as short as one and one half inches.

Figure 7:
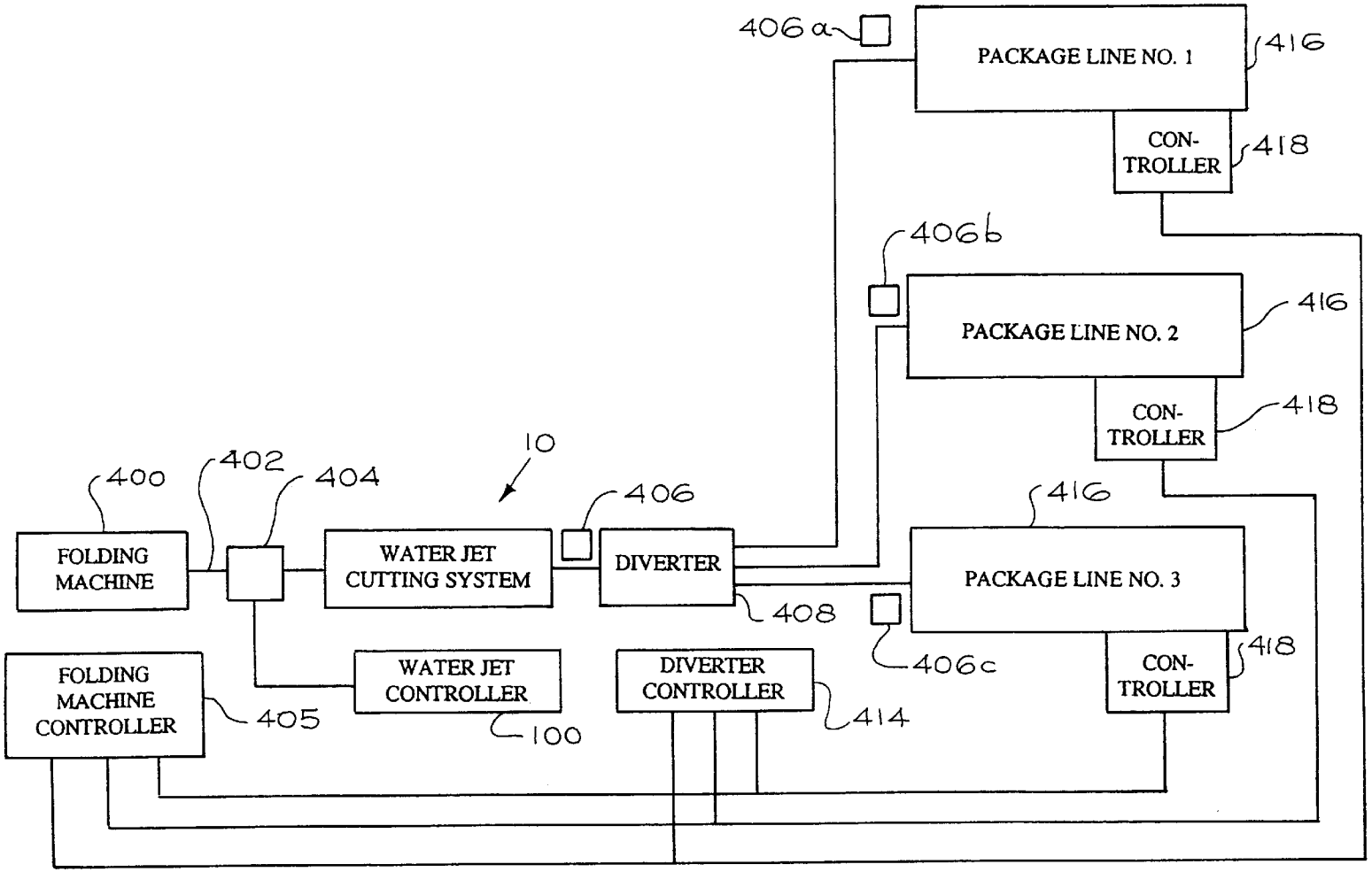
FIG. 7 is a block diagram of a production line operating in accordance with the present invention.
Figure 8:
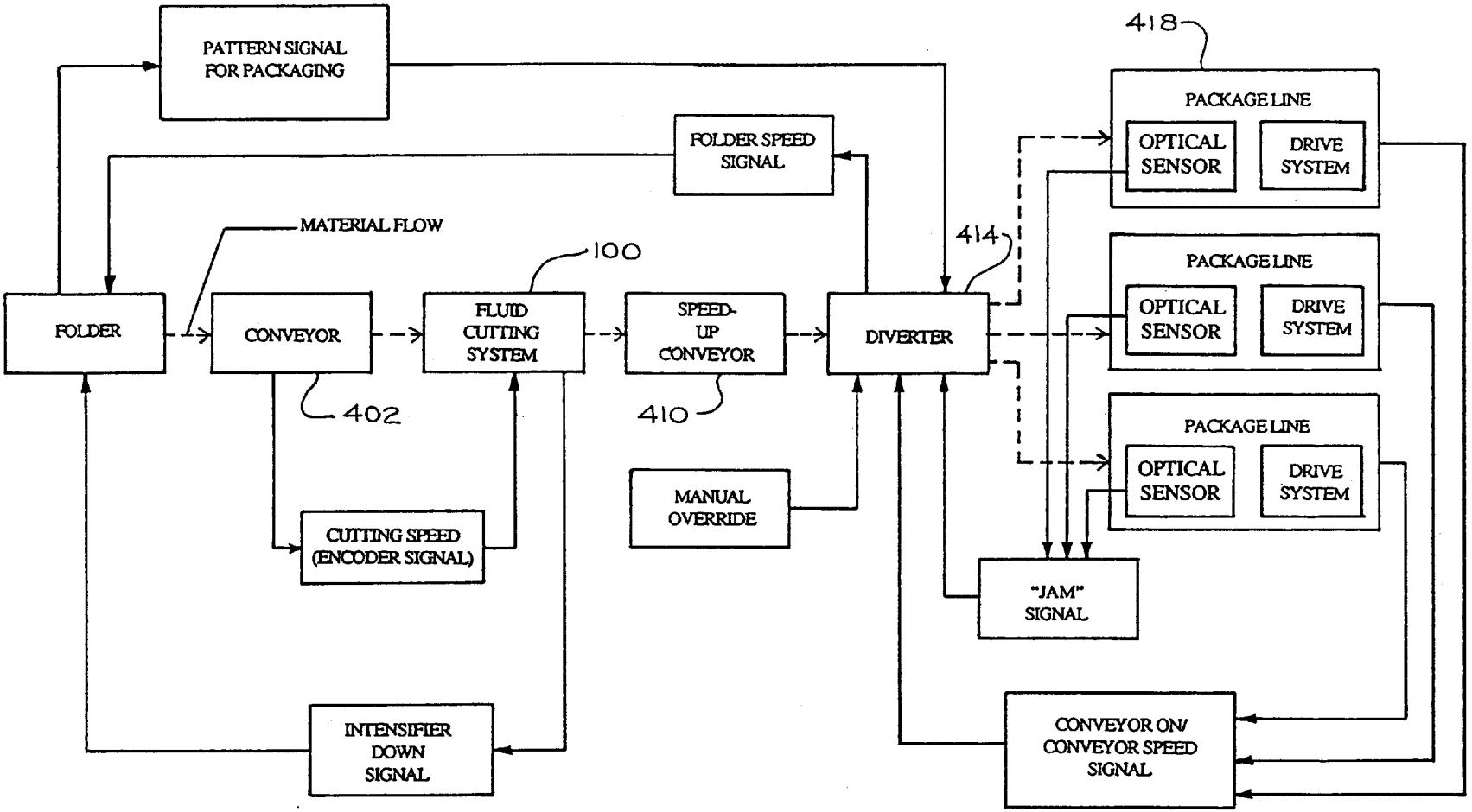
FIG. 8 is a flow chart of a preferred embodiment of a production line operating in accordance with the present invention.

Preferably, the water jet cutting system 10 is used in an automatically controlled production line for producing consumer-sized end products. Two embodiments of automatic production lines are shown in FIGS. 7 and 8. In the embodiment shown in FIG. 7, error and speed signals from the downstream packaging lines 416 are sent directly to the initial stage of the production line, in this case the folding controller 405. The embodiment of FIG. 8, however, shows a simplified version in which the diverter controller 414, located at an intermediate stage of the production, receives all signals from the packaging line, and controls production by supplying only a speed signal to the folder controller 405.

Preferably, the production line comprises a folding machine 400, fluid cutting system 10, diverter 408, and a plurality of packaging lines 416, all of which are interconnected through their respective controllers. Although a four stage converting operation is shown, stages can be added or subtracted to meet the requirements of the converting operation. Furthermore, it will also be understood that automatic production line could be used in any number of converting operations, and is not confined to fluid jet cutting.

Nonwoven or paper material is initially folded by the folding machine 400. The folding machine includes a conveyor 402, encoder 404, and folding machine controller 405. The folding machine 400 is preferably operated at a high rate of speed, and is capable of providing as much as 300 feet/minute of nonwoven or paper material to the fluid jet cutter 10. The speed of the folding machine conveyor 402 is monitored by the encoder 404, which is connected to the controller 100 of the fluid jet cutting system 10. The controller 100 uses data from the encoder 404 to determine the rate of speed of input material, and modifies the speed of the x-y motion of the nozzles 64, 66, and 68 based on this input. As noted above, the folder controller may receive only speed commands from the diverter controller 414 (FIG. 8), or may receive status information from the packaging lines 416 (FIG. 7).

After consumer-sized stacks of paper or nonwoven material 406 are cut by the fluid jet cutter 10, control transfers to a diverter 408. The diverter 408 includes a diverter conveyor 410, a sensor 412, and a diverter controller 414. The diverter conveyor 410 is a speed-up conveyor. A speed-up conveyor runs at a higher rate of speed in order to space the consumer-sized stacks 406 for packaging. The sensor 412 counts the number of stacks 406, and diverts a preprogrammed number of stacks 406*a*, 406*b*, and 406*c* to one of several packaging lines 416 for packaging.

Each packaging line 416 includes a packaging controller 418 capable of producing and transmitting signals to the controllers of other stages of the converting operation. Preferably, the packaging controller 418 monitors the drive system of each packaging conveyor to first determine whether the drive system is operational and, secondly, to determine the speed of the drive system. The packaging controller 418 preferably also includes a series of optical sensors which monitor the motion of material through the packaging line and provide a "jam" signal to indicate a malfunction. When a packaging line 416 malfunctions, i.e. the packaging line slows down or stops entirely, a signal is sent to other stages of production. When an error occurs the speed of the folding machine conveyor is automatically slowed. Although a command to modify the speed of the folding machine could come from any stage in the production line, preferably this command is established by the diverter controller 414, or directly by the folder controller 405 based on input from the packaging line controllers 418. The diverter also stops sending stacks 406 to the malfunctioning packaging line. Therefore, the production line can continue to operate while one or more packaging lines are disabled, thereby preventing costly down time.

Figure 9:
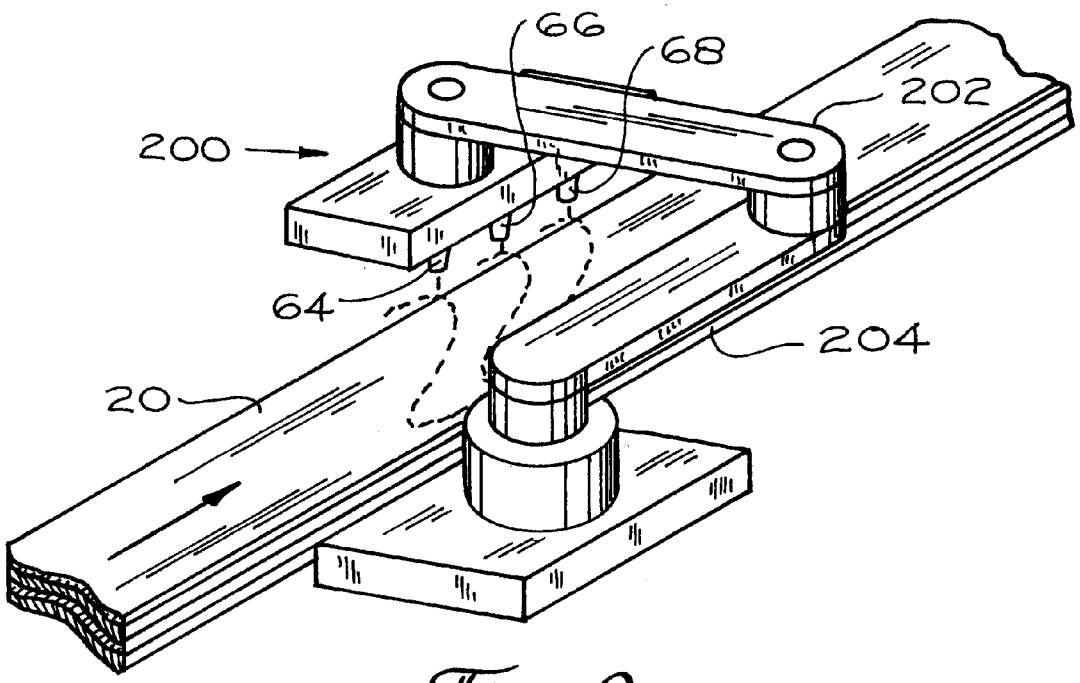
FIG. 9 is a view of an alternative embodiment of a fluid jet cutting apparatus provided by the invention, where the fluid cutting apparatus is mounted to a robot.

Referring to FIG. 9, an alternative embodiment of a fluid jet cutting apparatus is shown at 200. In this embodiment, a nozzle bracket is mounted to the arm 202 of an articulated robot 204. The arm 202 of the robot is positioned above a continuously moving web of material 20. The robot is programmed to move the arm in a figure eight pattern. As the arm moves, fluid 18 is directed from the nozzles 64, 66, and 68, onto the continuously moving web 20. Each figure eight movement of each nozzle 64, 66, and 68, results in two substantially perpendicular cuts across the web 20, for a total of six cuts for each cycle.

Figure 10:
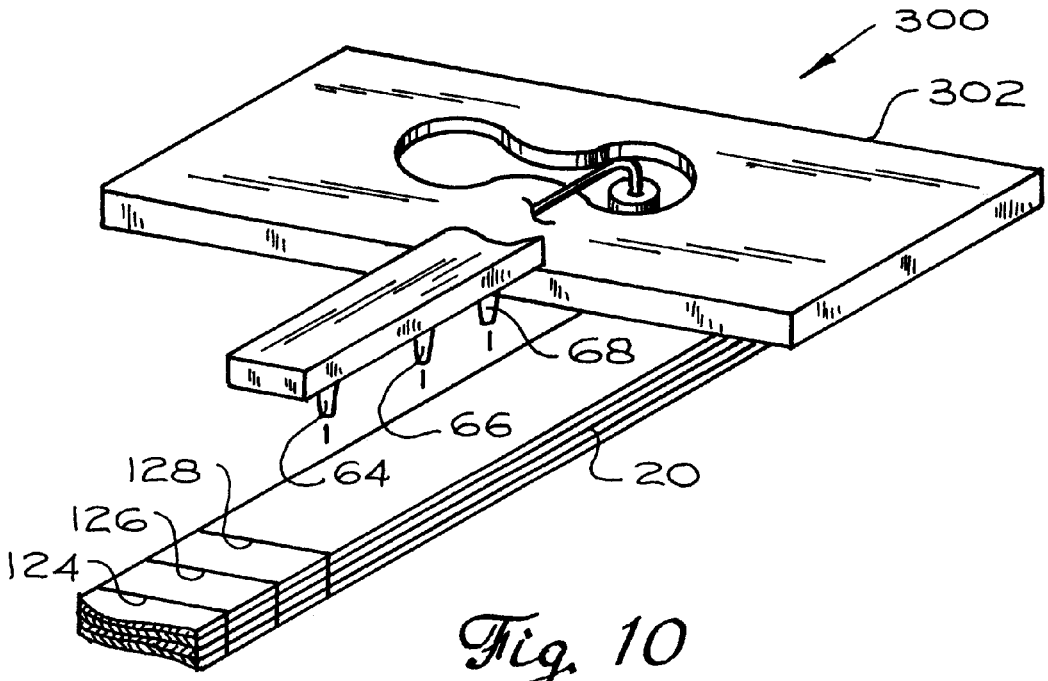
FIG. 10 is a view of an alternative embodiment of a fluid jet cutting apparatus provided by the invention in FIG. 1, where the fluid cutting apparatus is coupled to an overhead cam.

Referring to FIG. 10, another alternative embodiment of a fluid jet cutting system is shown at 300. In this embodiment, an overhead cam 302 is positioned above the continuously moving web of material 20. The cam is formed in the shape of a figure eight pattern. A nozzle bracket is coupled to a cam-follower 304. As the cam-follower 304 moves along the cam 302, the nozzles 64, 66 and 68 each cut a figure eight pattern in the continuously moving web 20, thereby providing six perpendicular cuts across the continuously moving web 20.

While preferred embodiments have been illustrated and described, it should be understood that changes and modifications can be made thereto without departing from the invention in its broadest aspects. Various features of the invention are defmed in the following claims.

What is claimed is:

1. A method for cutting a continuously moving web of material into sections, the web of material having first and second sides, said method comprising the steps of:

positioning a stationary mounting member along one side of a conveyor;

mounting a drive system to the stationary mounting member, the drive system comprising a second plate which is driven independently in a second axis by a second motor, and a first plate driven by a first motor, wherein a rail structure couples the first plate to the second plate such that the first plate and the second plate are driven simultaneously in the first axis;

mounting a plurality of nozzles to the second plate of the drive system such that the nozzles are driven simultaneously in parallel paths;

positioning the web of material on the conveyor having a longitudinal axis parallel to said second axis and a lateral axis parallel to said first axis;

positioning the nozzles above the web of material;

commanding said conveyor to move in a first direction at a predetermined web speed;

delivering a fluid at an intensified pressure to each of the plurality of nozzles, said nozzles being selectively moveable in the first axis and the second axis, said nozzles moving in parallel paths;

simultaneously directing a jet of said fluid from each of the plurality of nozzles onto the web;

first, driving said plurality of nozzles to move in said first and second axes from a first cut starting position at the first side of the web to a first cut ending position at the second side of the web which first cut ending position is also disposed in said first direction relative to said first cut starting position;

second, driving said plurality of nozzles to move in said first axis in a direction opposite to said first direction to a second cut starting position directly opposite the first cut starting position;

third, driving said plurality of nozzles to move in said first and second axes from said second cut starting position at the second side of the web to a second cut ending position at the first side of the web which second cut ending position is also disposed in said first direction relative to said second cut starting position; and fourth, driving said plurality of nozzles to move in said first axis in a direction opposite to said first direction to said first cut starting position directly opposite said second cut starting position.

2. The method as defined in claim 1, including the step of using the controller to control a travel speed and a travel direction of said plurality of nozzles.

3. The method as defined in claim 1, wherein the movement of said plurality of nozzles is controlled by a controller, including the step of storing at least one web speed value in a memory location in said controller and using said controller to compute a travel speed and a travel angle of the plurality of nozzles based on the cut length value and the web speed value.

4. The method as defined in claim 1, wherein the movement of said plurality of nozzles is controlled by a controller, including the steps of coupling an encoder to an input conveyor to produce an input speed signal, supplying the input speed signal to said controller, and causing said controller to continually compute a travel speed and a travel angle based on the input speed signal.

5. The method as defined in claim 4, including the steps of supplying the cut length value through an input device to said controller, storing the cut length value in a memory location, and calculating a travel speed and a travel angle of the nozzles based on the cut length value and the input speed signal.

6. The method as defined in claim 5, including the step of adjusting a relative distance between the plurality of nozzles to vary the cut length.

7. The method as defined in claim 4, including the steps of supplying the cut length value through a keypad, storing the cut length value in a memory location, and calculating a travel speed and a travel angle of the nozzles based on the cut length value and the input speed signal.

8. The method as defined in claim 1, wherein the movement of said plurality of nozzles is controlled by a controller, including the step of using an input device to said controller to selectively activate at least one of the plurality of nozzles.

9. The method as defined in claim 1, including the step of adjusting a relative distance between at least one of the plurality of nozzles and another of the plurality of nozzles to vary the cut length.

10. The method as defined in claim 1, including the step of coupling an encoder to the web to produce an input speed signal.

11. The method as defined in claim 10, including the steps of using said input speed signal to control a travel speed of the plurality of nozzles.

12. The method as defined in claim 1, further including the step of removing excess fluid with a wet vacuum system.

13. A method for cutting a continuously moving web of paper or non-woven material into sections, the web of material including first and second sides, said method comprising the steps of:

positioning the web of material on a conveyor having a longitudinal axis and a lateral axis;

commanding said conveyor to move in a first direction at a predetermined web speed and using an encoder monitoring the conveyor to provide an input speed signal to a controller;

positioning a drive system adjacent the web, the drive system comprising a first plate, a second plate, a first motor, and a second motor, wherein a rail structure couples the first plate to the second plate such that the first plate and the second plate are driven simultaneously by a first motor in a first axis, and a telescoping tram couples the second plate to the second motor such that the second plate is driven independently in a second axis perpendicular to the first axis;

delivering a fluid at an intensified pressure to each of the plurality of nozzles;

simultaneously directing a jet of said fluid from each of the plurality of nozzles onto the web;

first, calculating a travel angle and a travel speed for the plurality of nozzles based on the input speed signal and driving the first plate and the second plate in the first axis and the second plate in the second axis such that the nozzles move at the calculated travel angle from a first cut starting position at the first side of the web to a first cut ending position at the second side of the web which first cut ending position is also disposed in said first direction relative to said first cut starting position;

second, driving the first plate and the second plate in the first axis such that said plurality of nozzles moves in said first axis in a direction opposite to said first direction to a second cut starting position directly opposite the first cut starting position;

third, calculating the travel angle and the travel speed for the plurality of nozzles based on the input speed signal and driving the first plate and the second plate in the first axis and the second plate in the second axis such that the nozzles move at the calculated travel angle from said second cut starting position at the second side of the web to a second cut ending position at the first side of the web which second cut ending position is also disposed in said first direction relative to said second cut starting position; and fourth, driving the first plate and the second plate in the first axis such that said plurality of nozzles moves in said first axis in a direction opposite to said first direction to said first cut starting position directly opposite said second cut starting position.

14. The method as defined in claim 13, further including the step of adjusting the distance between the first, second, and third nozzles to provide a different cut length and inserting the cut length into a memory location through an input device to the controller such that the controller determines the travel angle and travel speed of the nozzles based on the cut length and the web speed.

15. An apparatus for cutting a continuously moving layered web of material comprising:

a conveyor;

a drive system, comprising a first motor driving a first plate and a second plate simultaneously in a first axis and a second motor driving the second plate independently in a second axis, wherein the second axis is perpendicular to the first axis such that the second plate is selectively driven at an angle between the first and second axis;

a plurality of nozzles moveably coupled to the second plate of said drive system, such that each of the nozzles is selectively positioned at a selected distance from an adjacent one of the nozzles and the nozzles are driven simultaneously by the drive system in fixed parallel paths during operation;

an intensifier, for intensifying the pressure of the fluid;

at least one valve, for supplying said fluid to said nozzles; and a controller, for controlling the motion of the drive mechanisms.

16. The apparatus as defined in claim 15, wherein said web comprises paper or nonwoven material.

17. The apparatus as defined in claim 15, wherein said fluid comprises water.

18. The apparatus as defined in claim 15, wherein said conveyor comprises a non-corrosive hardened metal or alloy that is resistant to fluid.

19. The apparatus as defined in claim 15, wherein said conveyor includes a series of stainless steel flights.

20. The apparatus as defined in claim 15, wherein said conveyor includes a series steel flights, wherein each of the steel flights include v-shaped edges which contact the web.

21. The apparatus as defined in claim 15, wherein said drive system includes a stationary base plate, an x-plate and a y-plate.

22. The apparatus as defined in claim 21, wherein said x-plate and said y-plate comprise an aluminum material with excess material removed to decrease the load.

23. The apparatus as defined in claim 15, wherein the drive system includes AC brushless servo motors.

24. The apparatus as defined in claim 15, wherein the drive system includes rack and pinion drives.

25. The apparatus as defined in claim 15, wherein each of the plurality of nozzles includes an orifice, and the diameter of the orifice is dimensioned to be substantially in the range from 0.008 to 0.018 inches.

26. The apparatus as defined in claim 15, the apparatus further comprising a vacuum system.

27. The apparatus as defined in claim 26, the wet vacuum system comprising a suction device and one or more vacuum manifolds connected to a drain pipe system, the vacuum manifolds including holes, the suction device extracting extraneous fluid through the holes.

28. An apparatus for cutting a continuously moving layered web of material comprising:

a conveyor comprising a plurality of v-shaped flights;

a drive system comprising a stationary mounting member, an x-plate, a y-plate, and a plurality of motors, wherein a first linear rail structure couples the y-plate to the x-plate such that the x-plate and the y-plate are driven simultaneously in the x-direction by an x-motor and a second linear rail structure couples the y-plate to a telescoping tram such that the stationary telescoping tram maintains contact with the y-plate as the y-plate moves in the x-axis and the y-plate is driven independently in the y-direction by a y-drive motor that drives the telescoping tram;

a plurality of nozzles coupled to a mounting rail coupled to the y-plate of said drive system, such that the plurality of nozzles are driven simultaneously in a parallel path in x and y Cartesian coordinates;

an intensifier, for intensifying the pressure of the fluid;

at least one valve, for supplying said fluid to said nozzles;

a controller, for controlling the motion of the drive mechanisms; and a wet vacuum system.

29. The method as defined in claim 1, further comprising the step of intensifying the fluid to a value substantially in the range from 40,000 to 50,000 pounds per square inch.

* * * * *